US010994392B2

(12) United States Patent
Hsu

(10) Patent No.: US 10,994,392 B2
(45) Date of Patent: May 4, 2021

(54) MULTI-FUNCTIONAL GRIP TOOL

(71) Applicant: Chang Hsueh-O Hsu, Taichung (TW)

(72) Inventor: Chang Hsueh-O Hsu, Taichung (TW)

(73) Assignee: Son Yuios Industrial Co., Ltd., Taichung (TW)

( * ) Notice: Subject to any disclaimer, the term of this patent is extended or adjusted under 35 U.S.C. 154(b) by 354 days.

(21) Appl. No.: 16/218,502

(22) Filed: Dec. 13, 2018

(65) Prior Publication Data

US 2019/0111549 A1 Apr. 18, 2019

(51) Int. Cl.

| | |
|---|---|
| ***B25B 13/56*** | (2006.01) |
| ***B25B 13/06*** | (2006.01) |
| ***B25G 1/08*** | (2006.01) |
| ***B25G 1/10*** | (2006.01) |
| ***B25F 1/02*** | (2006.01) |
| ***B25B 13/46*** | (2006.01) |

(52) U.S. Cl.

CPC ..... *B25B 13/56* (2013.01); *B25B 13/06* (2013.01); *B25B 13/46* (2013.01); *B25F 1/02* (2013.01); *B25G 1/085* (2013.01); *B25G 1/105* (2013.01)

(58) Field of Classification Search

CPC ..... B25B 13/56
USPC ..... 81/124
See application file for complete search history.

(56) References Cited

U.S. PATENT DOCUMENTS

| | | | | |
|---|---|---|---|---|
| 6,237,451 | B1 * | 5/2001 | Wei | B25G 1/085 81/177.4 |
| 6,327,942 | B1 * | 12/2001 | Mariol | B25G 1/085 81/177.4 |
| 2014/0013904 | A1 * | 1/2014 | Meholovitch | B25B 13/463 81/63.2 |
| 2016/0176023 | A1 * | 6/2016 | Chern | B25B 13/06 81/124.5 |

* cited by examiner

*Primary Examiner* — Orlando E Aviles
*Assistant Examiner* — Jonathan G Santiago Martinez

(57) ABSTRACT

A multi-functional grip tool has a plurality of sockets and a fixing member. One end of each socket has a joint portion. One side of the joint portion is fixedly connected to the fixing member. Another end of each the socket has a driving portion. A circumferential edge of an upper connecting seat has a plurality of upper accommodating recesses corresponding to the sockets. A circumferential edge of a lower connecting seat has a plurality of lower accommodating recesses corresponding to the sockets. When the upper connecting seat and the lower connecting seat are joined together, the sockets are accommodated between the upper accommodating recesses and the lower accommodating recesses, respectively. The upper connecting seat and the lower connecting seat are formed with protruding seats, respectively. The protruding seat defines a receiving room therein. A tool lid is disposed on an opening of the receiving room.

4 Claims, 12 Drawing Sheets

MULTI-FUNCTIONAL GRIP TOOL

FIELD OF THE INVENTION

The present invention relates to a multi-functional grip tool, which is a hand tool with an innovative structural design for accommodating screwdriver bits in a tool lid conveniently and carrying and using the screwdriver bits conveniently.

BACKGROUND OF THE INVENTION

A conventional grip tool is provided with at least six driving portions on the surface of a main body. Each of the driving portions defines a plane on the surface of the main body. The extension lines of the planes do not overlap each other, so that the driving portions have multi-directional openings. The driving portions are adapted for nuts of various sizes. When the operator uses one of the driving portions to lock a nut, the main body is rotated about the axis of the driving portion, and the driving portion is rotated for the operator to rotate the nut effortlessly. The conventional grip tool improves the inconvenience of carrying a variety of tools and increases the ease of operation.

However, the conventional grip tool is generally made of a metal (for example, steel) material in order to provide sufficient driving force for each of the driving portions. The conventional grip tool is bulky and heavy, and the processing cost is high (the multi-directional driving portions are manufactured by using a multi-spindle machine). The grip is very cumbersome, and the operator must spend a lot of effort to operate or carry the conventional grip tool. The conventional grip tool uses each driving portion to lock a polygonal nut or screw. When it is necessary to use a screwdriver bit for locking a screw, the screwdriver bit is taken out from a separately prepared tool case, and then the screwdriver bit is mounted in the driving portion. As a result, the operator needs to prepare a lot of tools, which is inconvenient to carry. Accordingly, the inventor of the present invention has devoted himself based on his many years of practical experiences to solve these problems.

SUMMARY OF THE INVENTION

The primary object of the present invention is to provide a multi-functional grip tool. The multi-functional grip tool comprises an inner main body, an upper connecting seat, and a lower connecting seat. The inner main body has a plurality of sockets and at least one fixing member. One end of each of the sockets has a joint portion. One side of the joint portion is fixedly connected to the fixing member. Another end of each of the sockets has a driving portion. A circumferential edge of the upper connecting seat has a plurality of upper accommodating recesses corresponding to outer diameters of the sockets. A circumferential edge of the lower connecting seat has a plurality of lower accommodating recesses corresponding to the outer diameters of the sockets. When the upper connecting seat and the lower connecting seat are joined together, the sockets are accommodated between the plurality of upper accommodating recesses and the plurality of lower accommodating recesses, respectively.

Preferably, an upper end of the upper connecting seat and a lower end of the lower connecting seat are formed with protruding seats, respectively. At least one of the protruding seats defines a receiving room therein. A tool lid is disposed on an opening of the receiving room. The tool lid has a plurality of accommodating holes therein. At least one of the accommodating holes is provided with a screwdriver bit.

Preferably, outer circumferences of the upper end of the upper connecting seat and the lower end of the lower connecting seat have a plurality of marks corresponding in position to the sockets.

Preferably, outer circumferences of the upper end of the upper connecting seat and the lower end of the lower connecting seat are integrally formed with an outer cover. The driving portion of each of the sockets is exposed outside the outer cover. The outer cover has a plurality of specification character marks corresponding in position to the respective sockets.

Preferably, each of the protruding seats at the upper end of the upper connecting seat and the lower end of the lower connecting seat is formed with the receiving room and a through hole. The through holes of the protruding seats communicate with each other. The tool lid is disposed on the opening of the receiving room of each of the protruding seats.

Preferably, the tool lid disposed on the opening of the receiving room has a tool insertion groove therein. The tool insertion groove is configured to receive a connecting rod passing through the through hole. One end of the connecting rod has a connecting head, and another end of the connecting rod has a receiving hole for insertion of the screwdriver bit.

DETAILED DESCRIPTION OF THE PREFERRED EMBODIMENTS

Figure 1:
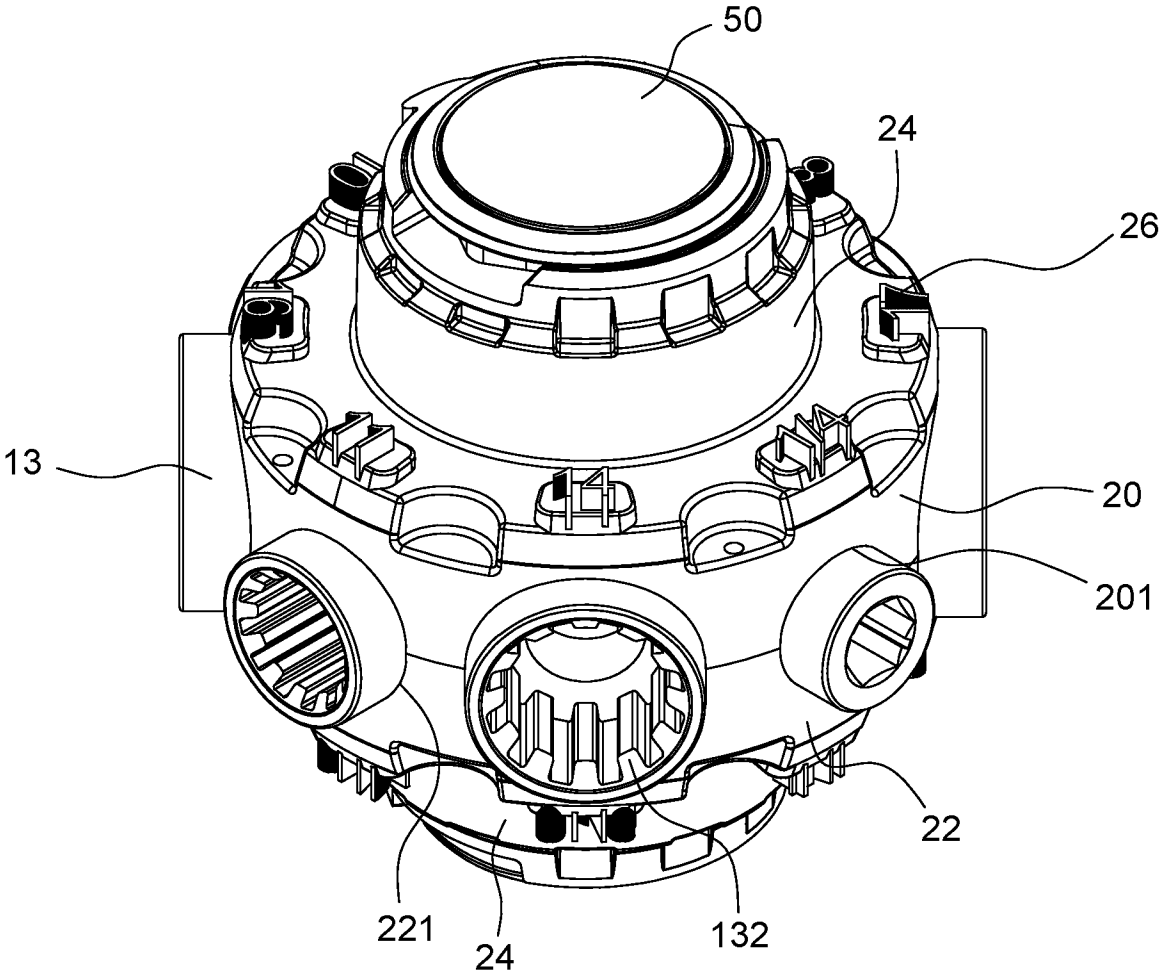
FIG. 1 is a perspective view in accordance with a first embodiment of the present invention.

Embodiments of the present invention will now be described, by way of example only, with reference to the accompanying drawings.

Referring to FIG. 1 to FIG. 7, a multi-functional grip tool according to a first embodiment of the present invention comprises an inner main body 10, an upper connecting seat 20, and a lower connecting seat 22.

The inner main body 10 has a plurality of sockets 13 and at least one fixing member 15 (a fixing plate). One end of each of the sockets 13 has a joint portion 131 in the form of a post having the same outer diameter. One side of the joint portion 131 is welded and fixed to the fixing member 15, so that the manufacturing cost is reduced and it is very easy to manufacture. Preferably, two sides of the joint portion 131 of each of the sockets 13 are welded and fixed to the fixing member 15.

Another end of each of the sockets 13 has a driving portion 131. The inner diameters of the driving portions 132 are different in size. Each of the driving portions 132 is a non-circular hole, a polygonal hole or a ratchet device, used for connecting other tools or workpieces and driving the tools or workpieces to rotate.

The circumferential edge of the upper connecting seat 20 has a plurality of upper accommodating recesses 201 corresponding to the outer diameters of the sockets 13, respectively. The circumferential edge of the lower connecting seat 22 has a plurality of lower accommodating recesses 221 corresponding to the outer diameters of the sockets 13, respectively.

Figure 2:
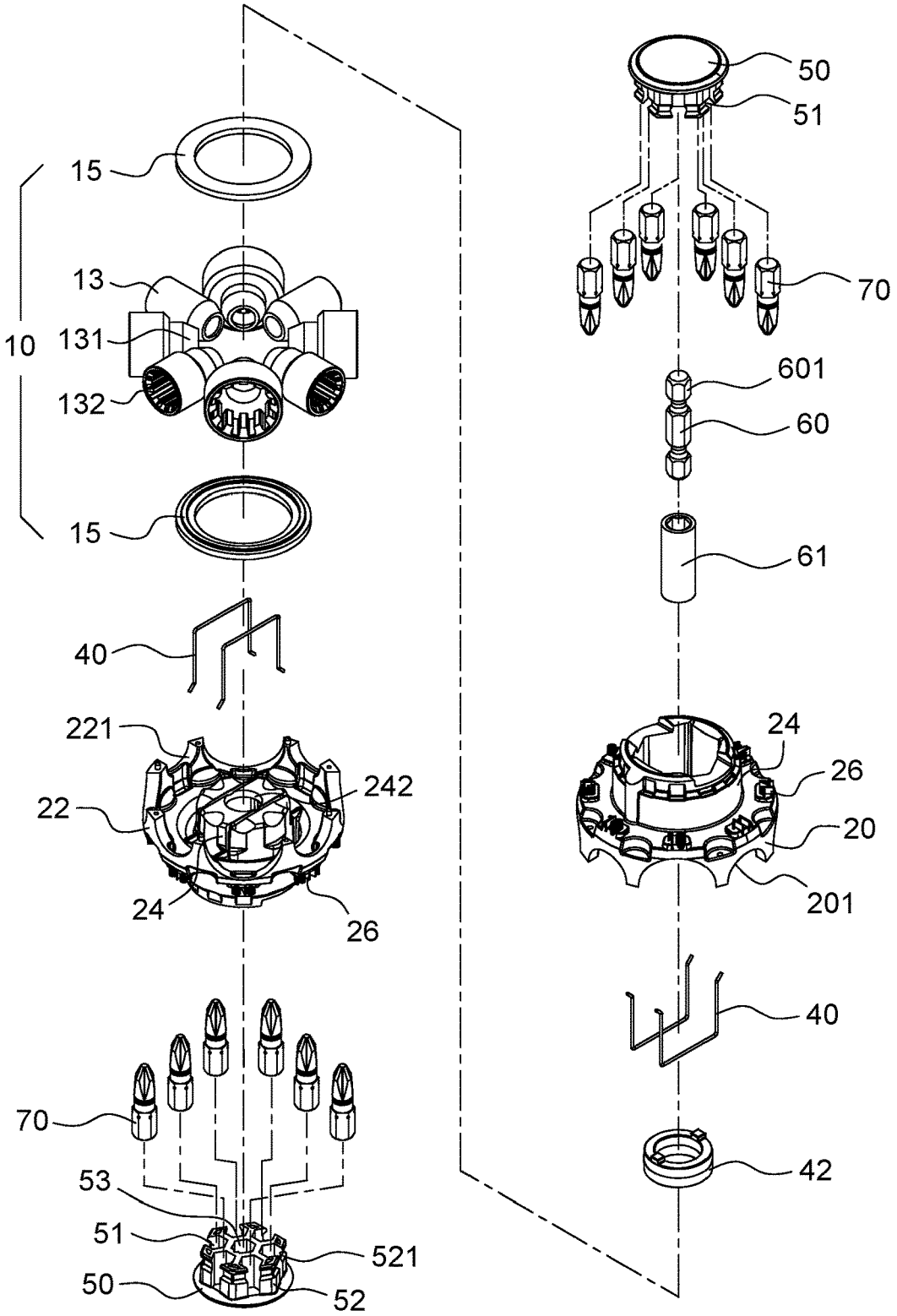
FIG. 2 is an exploded view in accordance with the first embodiment of the present invention.
Figure 3:
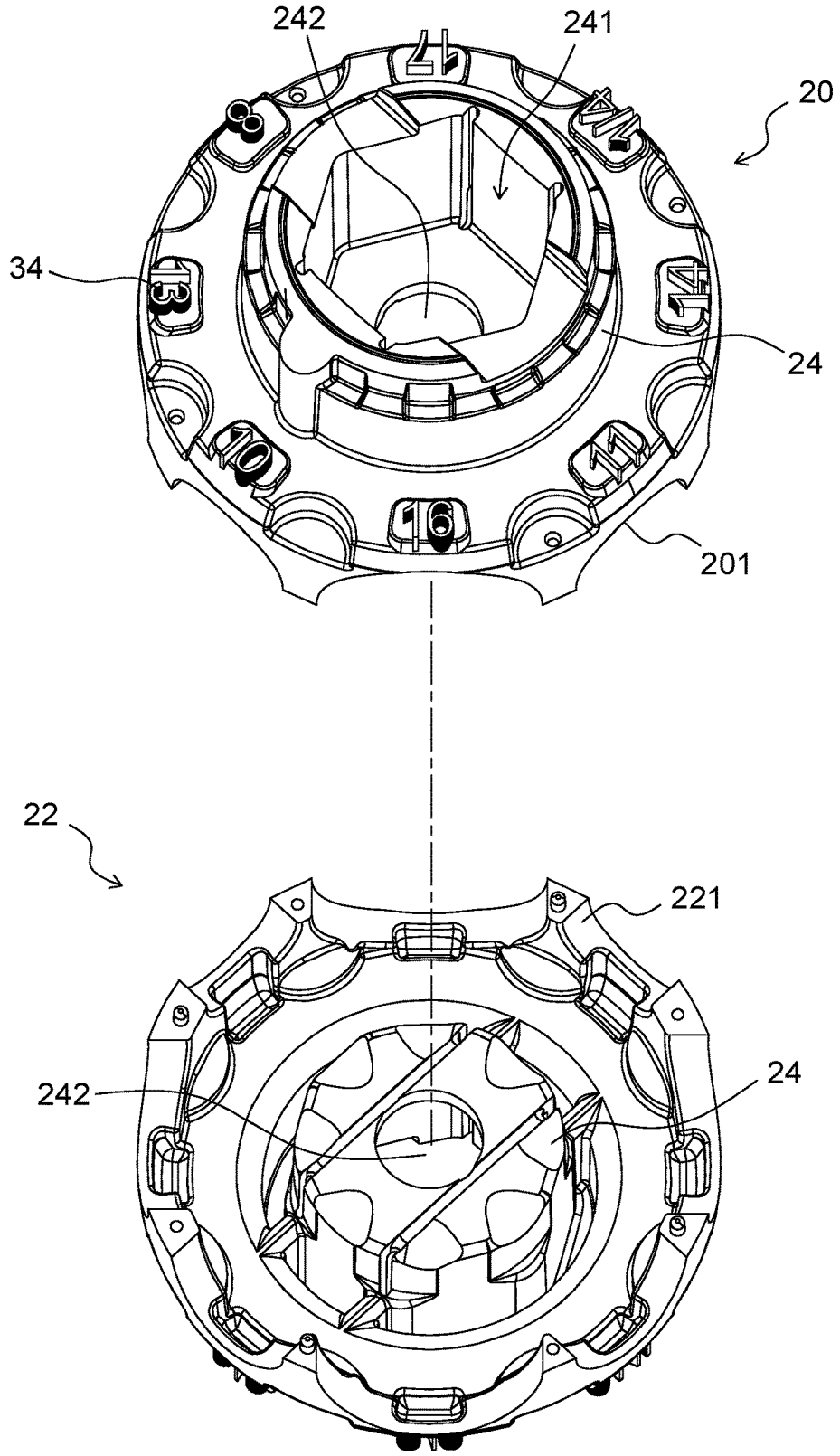
FIG. 3 is a perspective view of the upper connecting seat and the lower connecting seat of the present invention.

Referring to FIG. 3 in cooperation with FIG. 2, when the upper connecting seat 20 and the lower connecting seat 22 are joined together, the sockets 13 are accommodated between the plurality of upper accommodating recesses 201 and the plurality of lower accommodating recesses 221, respectively.

Figure 4:
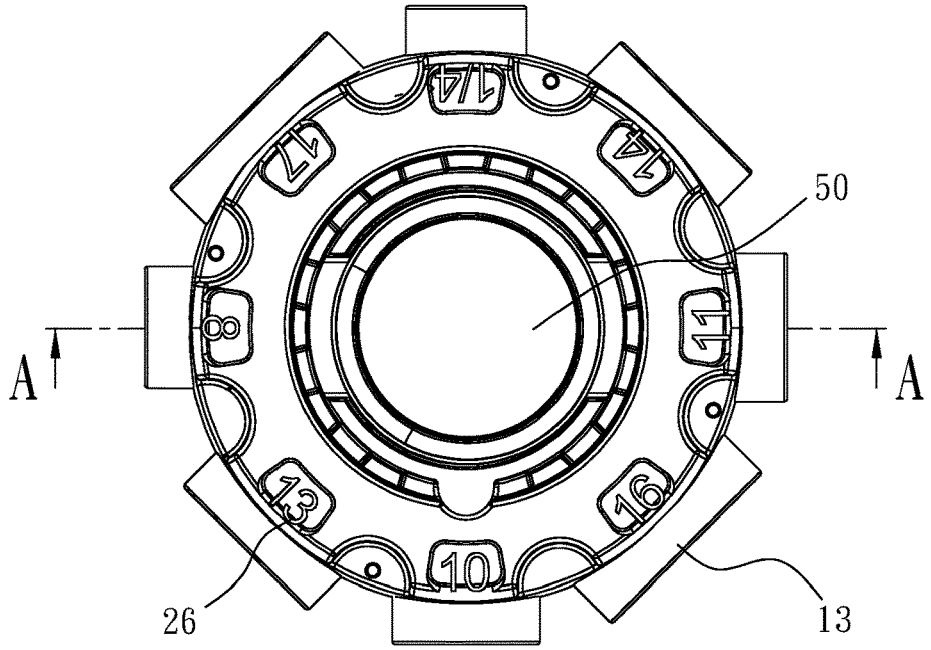
FIG. 4 is a top view in accordance with the first embodiment of the present invention.
Figure 4A:
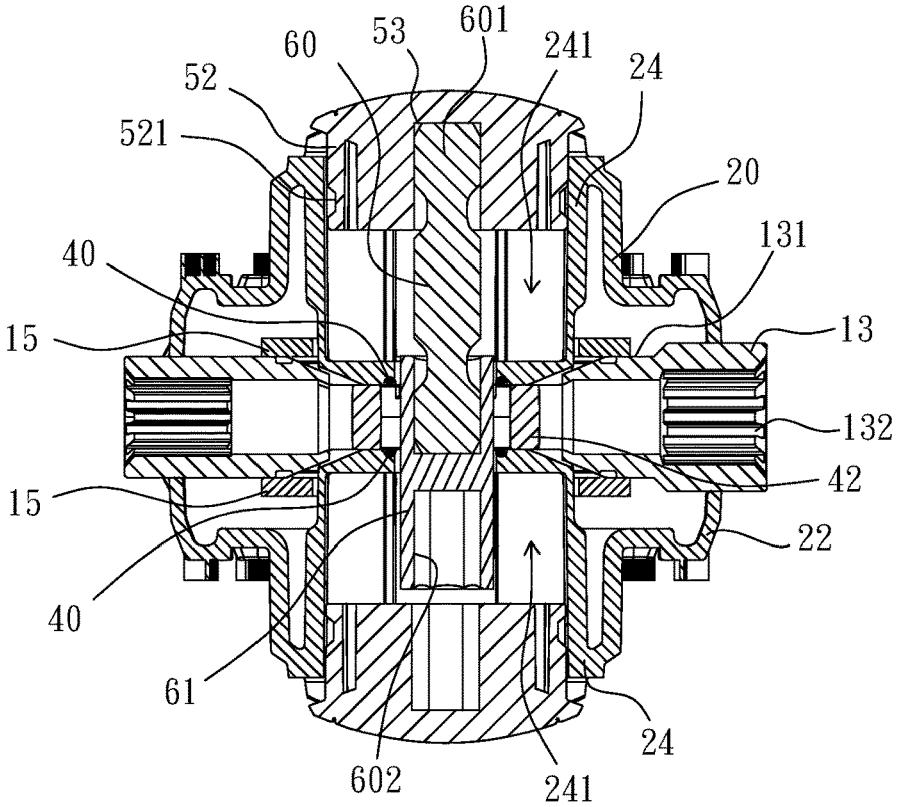
FIG. 4A is a cross-sectional view taken along line A-A of FIG. 4.

Referring to FIG. 4 to FIG. 4A, an upper end of the upper connecting seat 20 and a lower end of the lower connecting seat 22 are formed with protruding seats 24, respectively. At least one of the protruding seats 24 defines a receiving room 241 therein. A tool lid 50 is disposed on an opening of the receiving room 241. The tool lid 50 has a plurality of accommodating holes 51 therein. At least one of the accommodating holes 51 is provided with a screwdriver bit 70. One end of the screwdriver bit 70 is a polygonal post, and the other end is a working portion that is a flat head or a Phillips head. The outer circumferences of the upper end of the upper connecting seat 20 and the lower end of the lower connecting seat 22 have a plurality of marks 26 corresponding in position to the sockets 13 for the operator to identify the sockets.

Preferably, the receiving room 241 of the at least one of the protruding seats 24 has at least one set of springs 40. The tool lid 50 has a body portion 52 embedded in the receiving room 241. The body portion 52 is formed with engaging grooves 521 relative to the elastic acting ends of the set of springs 40. The elastic acting ends of the set of springs 40 are engaged in the engaging grooves 521, thereby preventing the tool lid 50 from disengaging from the receiving room 241 by accident and providing a stable clamping force.

Furthermore, the at least one set of springs 40 is secured to one end face of the at least one of the protruding seats 24 by a retaining member 42 to prevent the at least one set of springs 40 from being biased or loosened.

In detail, each of the protruding seats 24 at the upper end of the upper connecting seat 20 and the lower end of the lower connecting seat 22 is formed with the receiving room 241 and a through hole 242. The through holes 242 of the protruding seats 24 communicate with each other. The tool lid 50 is disposed on the opening of the receiving room 241 of each of the protruding seats 24.

The tool lid 50 disposed on the opening of the receiving room 241 has a tool insertion groove 53 therein. The tool insertion groove 53 is configured to receive a connecting rod 60 passing through the through hole 242. One end of the connecting rod 60 has a connecting head 601, and another end of the connecting rod 60 has a receiving hole 602 for insertion of the screwdriver bit 70, thereby improving the storability. Therefore, the through hole 242 is an innovative design to accommodate the connecting rod 60.

In the implementation of the present invention, the connecting head 601 of the connecting rod 60 is a hexagonal head, and the receiving hole 602 is a hexagonal hole. The receiving hole 602 is integrally formed on the connecting rod 60. Alternatively, the hexagonal receiving hole 602 is formed in a connecting sleeve 61 so that the connecting sleeve 61 can be detachably connected to one end of the connecting rod 60.

Figure 5:
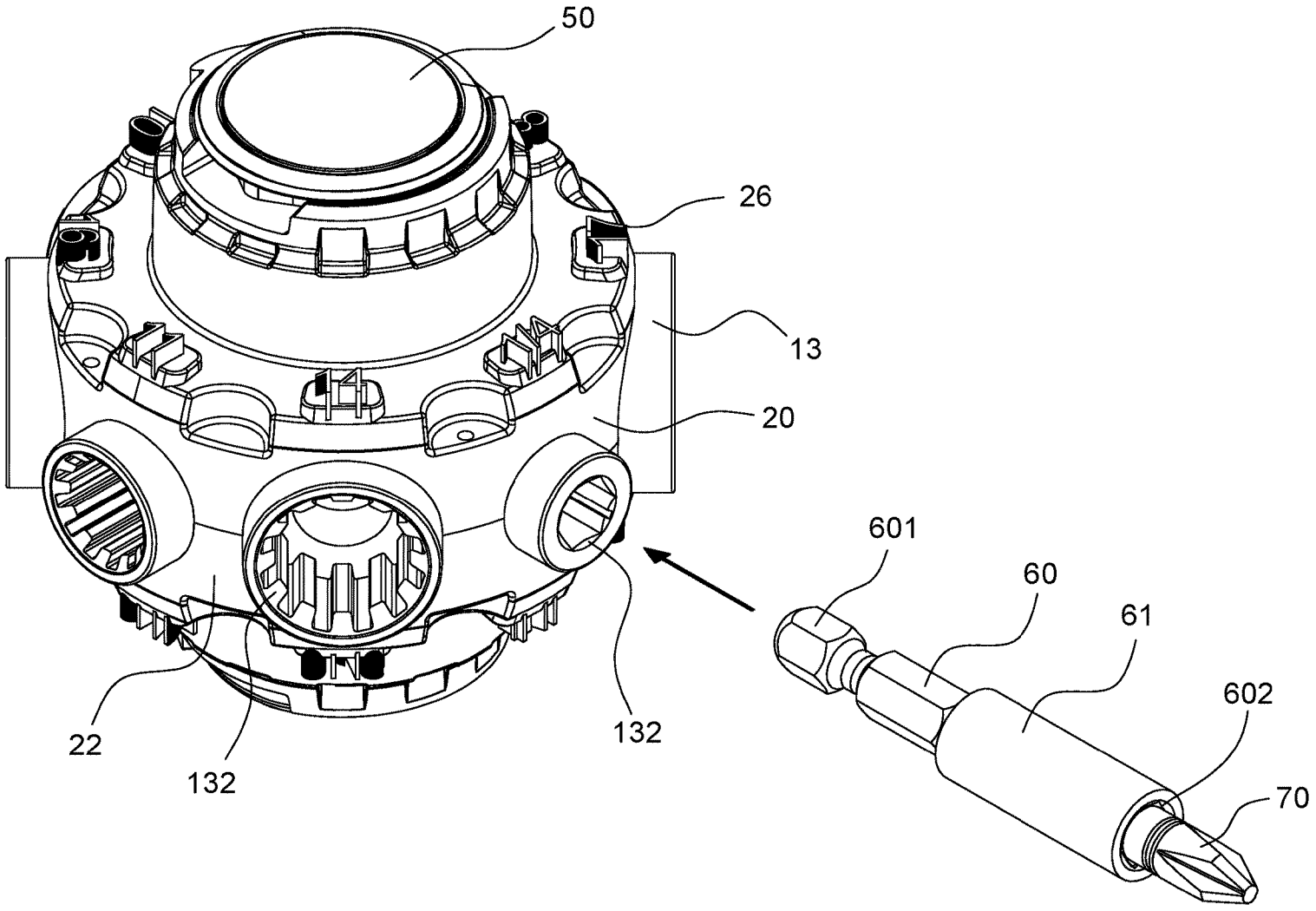
FIG. 5 is a schematic view showing the assembly implementation of the first embodiment of the present invention.
Figure 6:
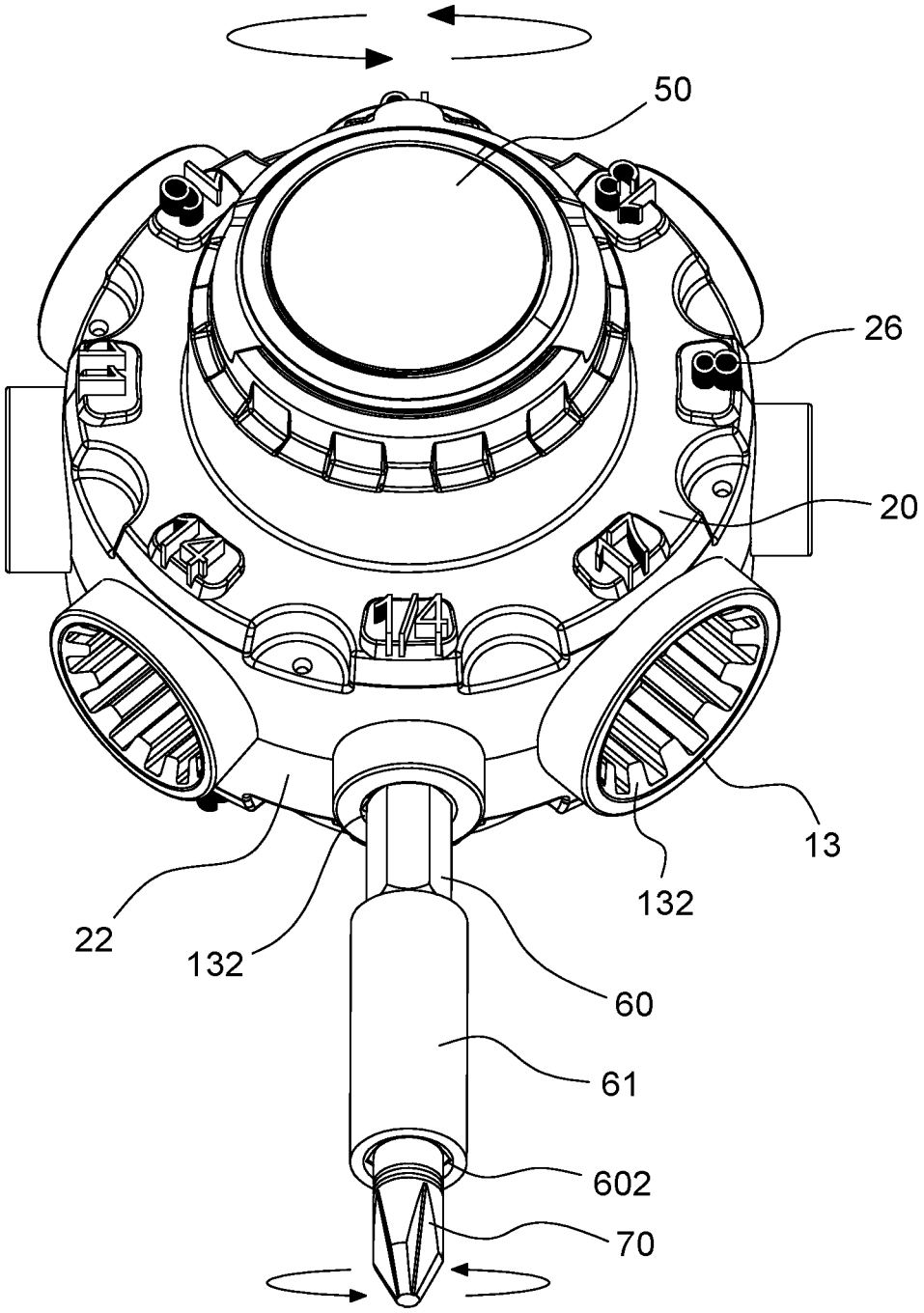
FIG. 6 is a schematic view showing the operation of the first embodiment of the present invention.

Please refer to FIG. 5 in cooperation with FIG. 2, illustrating the first operational embodiment of the present invention. The connecting rod 60 and the screwdriver bit 70 are pulled out from one of the tool lids 50. The hexagonal end of the screwdriver bit 70 is mounted in the receiving hole 602 of the connecting rod 60. The connecting head 601 of the connecting rod 60 is inserted into the driving portion 132 having a hexagonal hole. As shown in FIG. 6, the operator can grip the surfaces of the upper connecting seat 20 and the lower connecting seat 22 and rotate the driving portion 132, such that the screwdriver bit 70 can be used to lock a screw.

Figure 7:
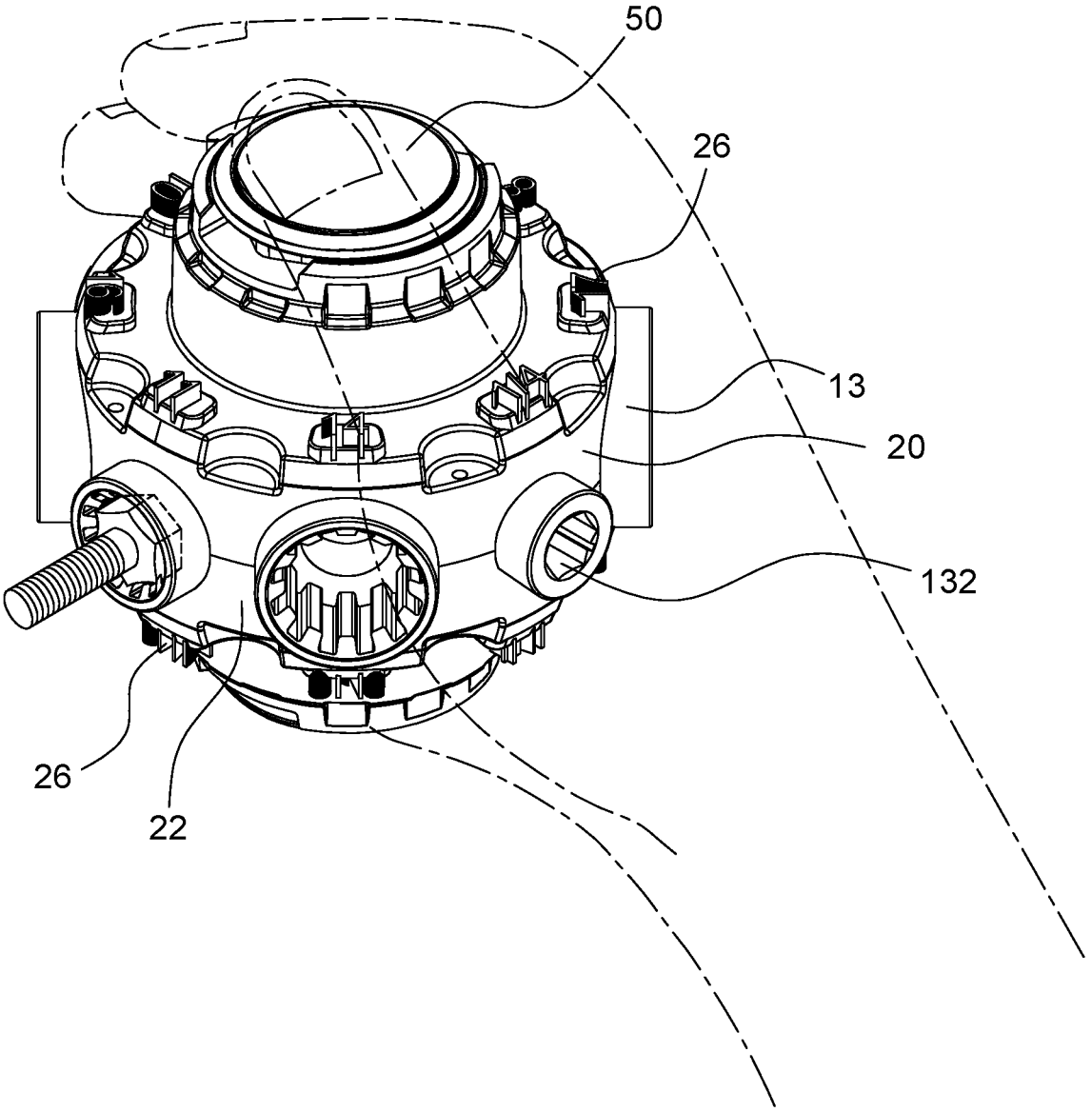
FIG. 7 is a schematic view showing the driving portion of the first embodiment of the present invention when in use.

In addition, referring to FIG. 7, the upper end of the upper connecting seat 20 and the lower end of the lower connecting seat 22 of the present invention have the marks 26 corresponding to the driving portions 132, respectively. For example, the embodiment has a nut of 11 mm. One side of the driving portion 132 has a corresponding 11 mm mark. The operator can work with the driving portion 132 of the 11 mm ratchet to lock the nut to the target, thereby improving the ease of operation.

Figure 8:
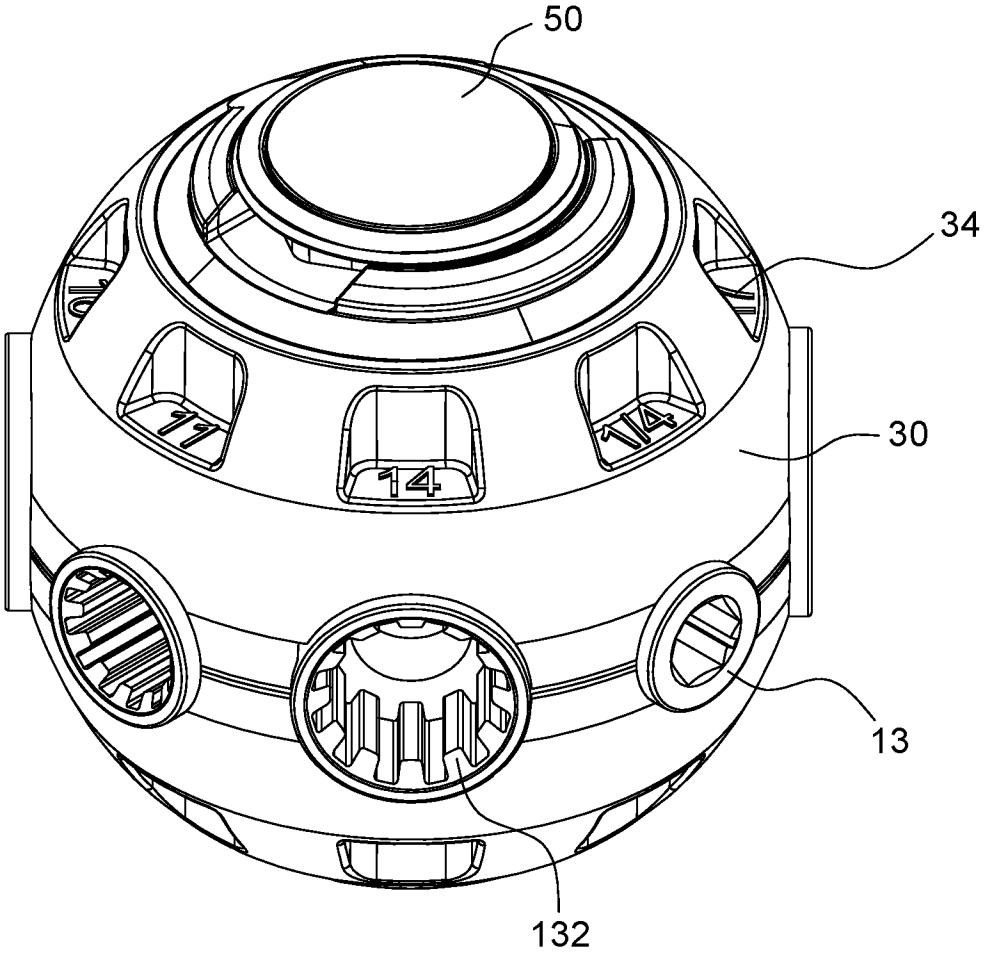
FIG. 8 is a perspective view in accordance with a second embodiment of the present invention.
Figure 9:
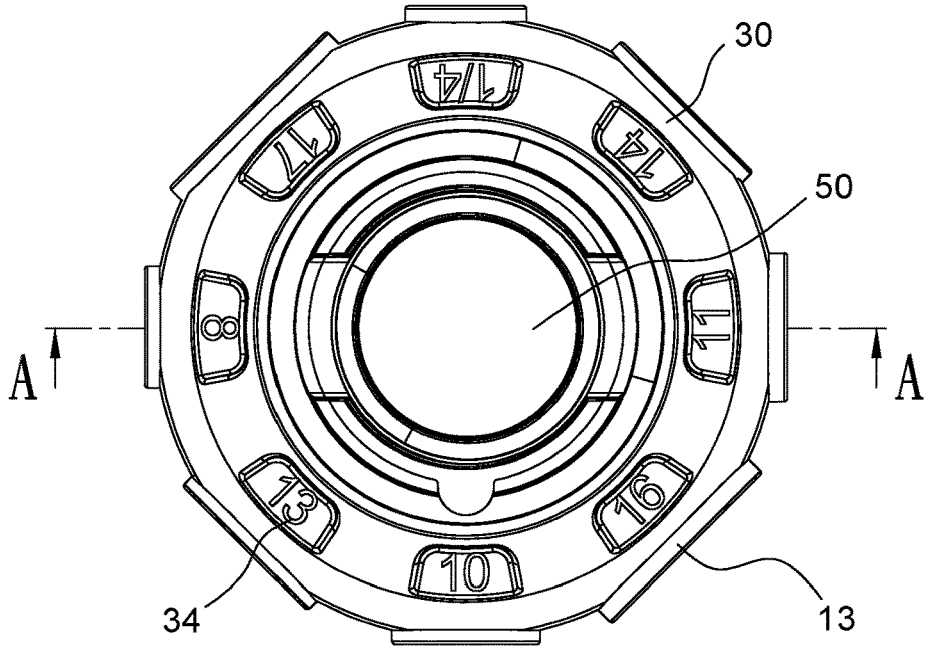
FIG. 9 is a top view in accordance with the second embodiment of the present invention.
Figure 9A:
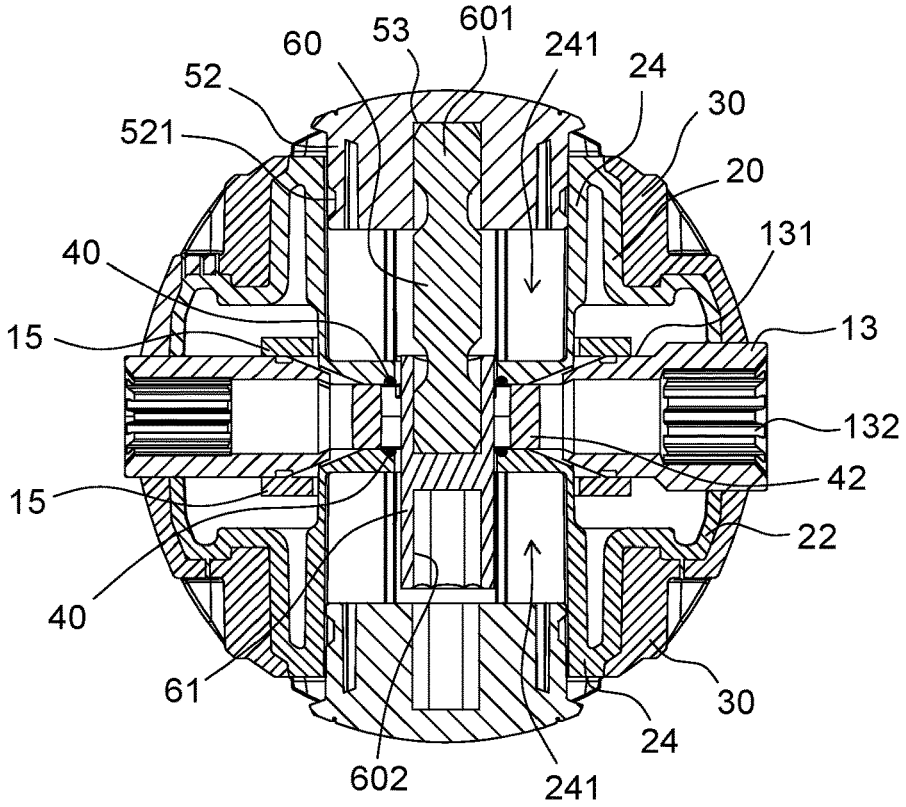
FIG. 9A is a cross-sectional view taken along line A-A of FIG. 9.

Referring to FIG. 8 to FIG. 9A in cooperation with FIG. 2, in the second embodiment of the present invention, the outer circumferences of the upper end of the upper connecting seat 20 and the lower end of the lower connecting seat 22 are integrally formed with an outer cover 30. The driving portion 132 of each socket 13 is exposed outside the outer cover 30. The outer cover 30 has a plurality of specification character marks 34 corresponding in position to the sockets 13, providing the corresponding number of the sockets 13 for the operator to identify the sockets.

Figure 10:
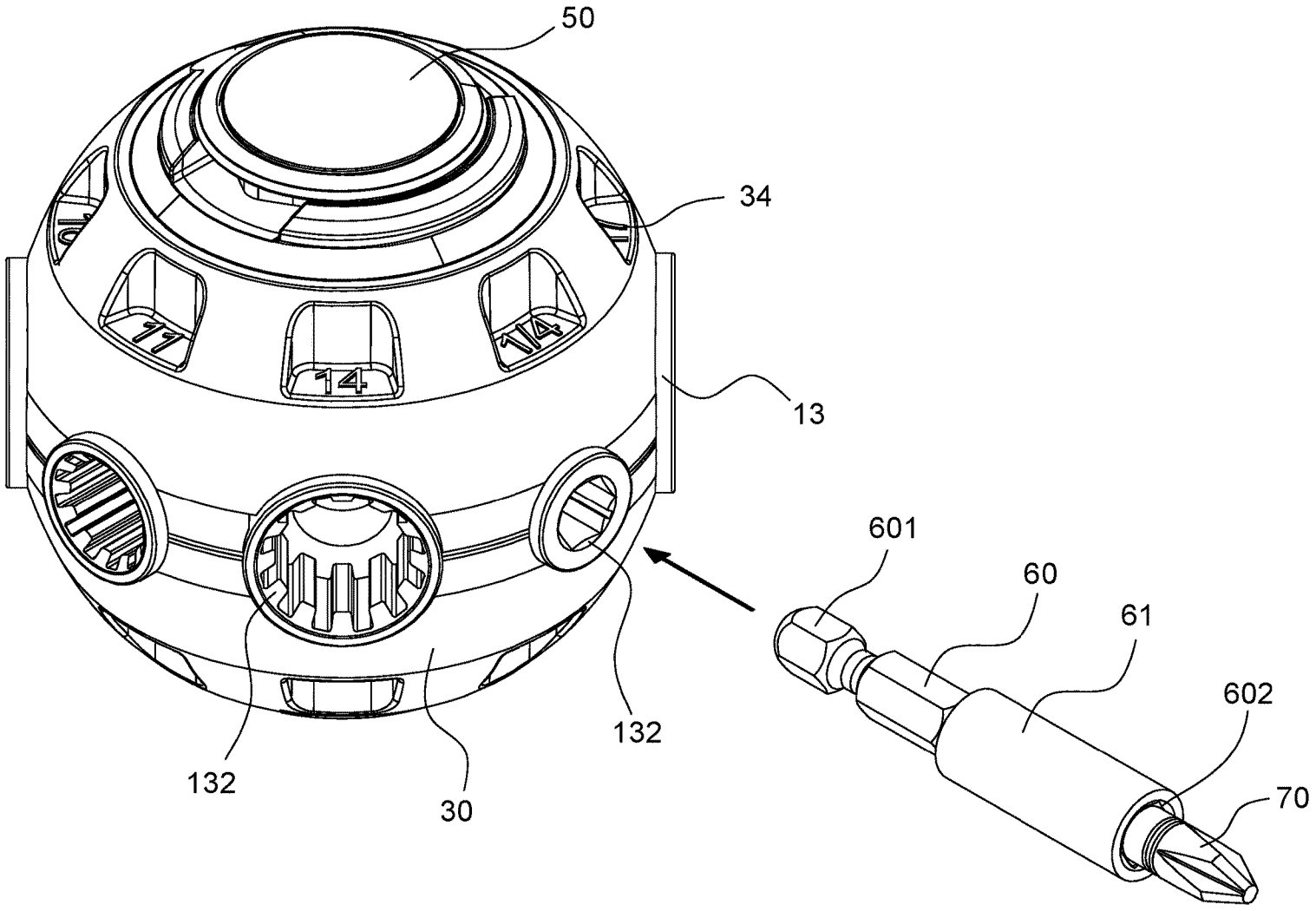
FIG. 10 is a schematic view showing the assembly implementation of the second embodiment of the present invention.
Figure 11:
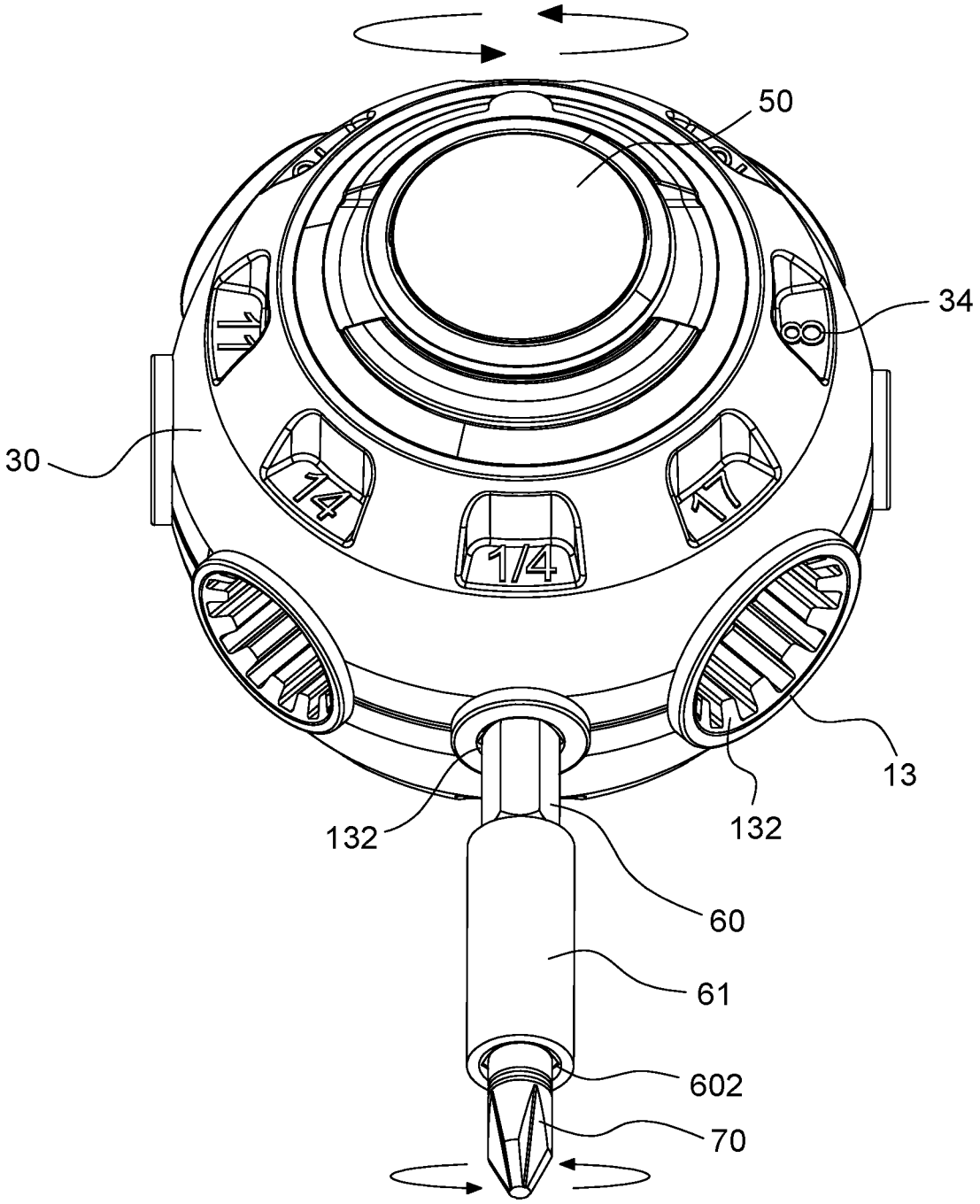
FIG. 11 is a schematic view showing the operation of the second embodiment of the present invention.

Please refer to FIG. 10 in cooperation with FIG. 2, illustrating the second operational embodiment of the present invention. The connecting rod 60 and the screwdriver bit 70 are pulled out from one of the tool lids 50. The hexagonal end of the screwdriver bit 70 is mounted in the receiving hole 602 of the connecting rod 60. The connecting head 601 of the connecting rod 60 is inserted into the driving portion 132 having a hexagonal hole. As shown in FIG. 11, the operator can grip the surface of the outer cover 30 and rotate the driving portion 132, such that the screwdriver bit 70 can be used to lock a screw.

Figure 12:
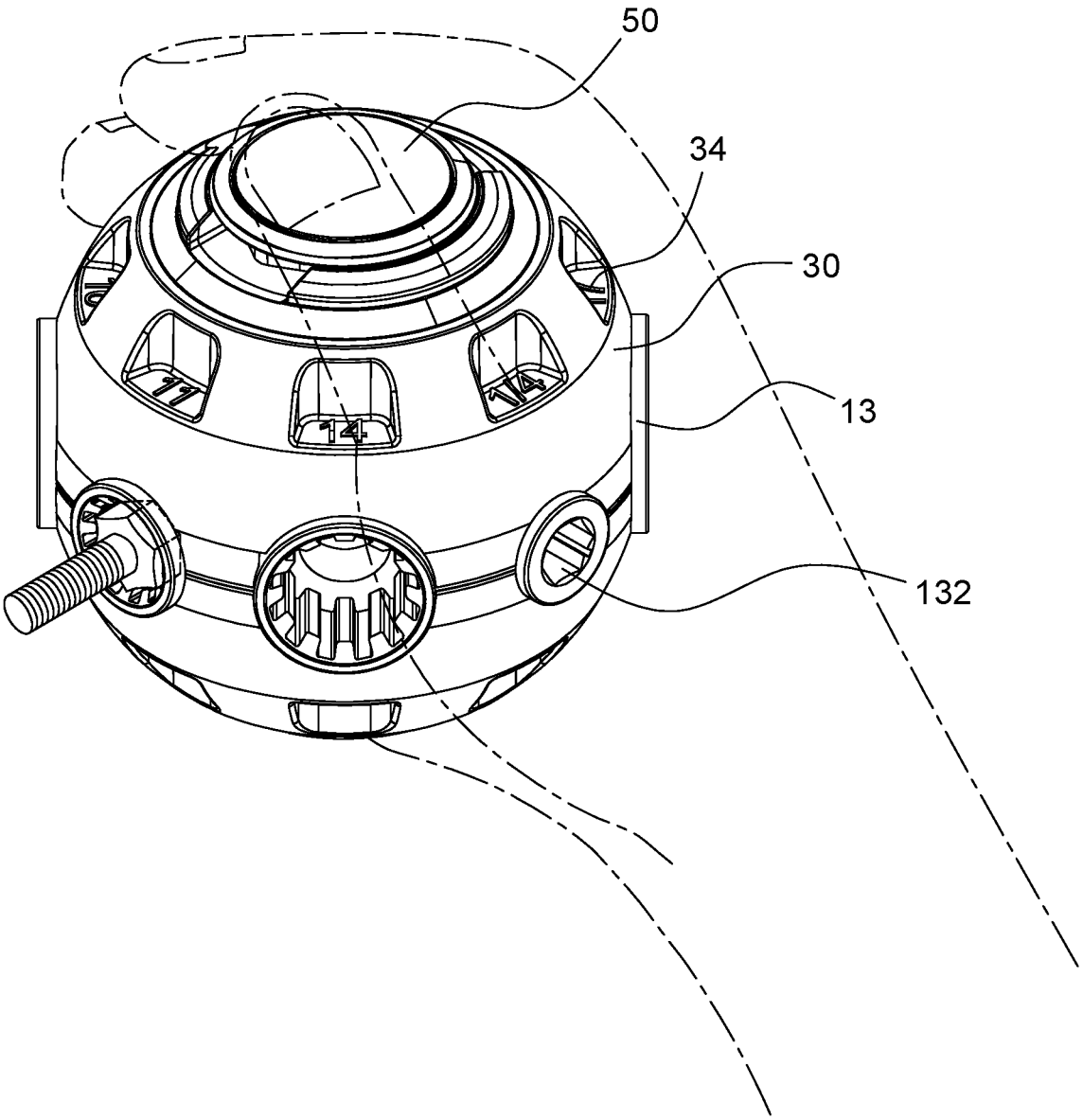
FIG. 12 is a schematic view showing the driving portion of the second embodiment of the present invention when in use.

Finally, referring to FIG. 12, the outer cover 30 of the present invention has the specification character marks 34 corresponding to the driving portions 132 respectively. For example, the embodiment has a nut of 11 mm. One side of the driving portion 132 has a corresponding 11 mm mark. The operator can work with the driving portion 132 of the 11 mm ratchet to lock the nut to the target, thereby improving the ease of operation.

Therefore, the present invention is a multi-functional grip tool which has a low manufacturing cost, a lightweight structure with high driving force, an excellent grip feeling and portability.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A multi-functional grip tool, comprising:

an inner main body, the inner main body having a plurality of sockets and at least one fixing member, one end of each of the sockets having a joint portion, one side of the joint portion being fixedly connected to the fixing member, another end of each of the sockets having a driving portion;

an upper connecting seat, a circumferential edge of the upper connecting seat having a plurality of upper accommodating recesses corresponding to outer diameters of the sockets; and a lower connecting seat, a circumferential edge of the lower connecting seat having a plurality of lower accommodating recesses corresponding to the outer diameters of the sockets;

wherein when the upper connecting seat and the lower connecting seat are joined together, the sockets are accommodated between the plurality of upper accommodating recesses and the plurality of lower accommodating recesses, respectively;

wherein an upper end of the upper connecting seat and a lower end of the lower connecting seat are formed with protruding seats respectively, at least one of the protruding seats defines a receiving room therein, and a tool lid is disposed on an opening of the receiving room; and wherein outer circumferences of the upper end of the upper connecting seat and the lower end of the lower connecting seat are integrally formed with an outer cover, and the driving portion of each of the sockets is exposed outside the outer cover.

2. The multi-functional grip tool of claim 1, wherein the outer cover has a plurality of specification character marks corresponding in position to the respective sockets.

3. The multi-functional grip tool of claim 1, wherein the receiving room has at least one set of springs, the tool lid has a body portion embedded in the receiving room, the body portion is formed with engaging grooves relative to elastic acting ends of the set of springs, and the elastic acting ends of the set of springs are engaged in the engaging grooves to prevent the tool lid from disengaging from the receiving room.

4. The multi-functional grip tool of claim 3, wherein the at least one set of springs is secured to one end face of the at least one of the protruding seats by a retaining member.

* * * * *